US008746457B2

(12) United States Patent
Zhang et al.

(10) Patent No.: US 8,746,457 B2
(45) Date of Patent: Jun. 10, 2014

(54) METHOD AND DEVICE FOR AXIAL SEPARATION BY THE INNER SURFACE OF A PERMANENT MAGNETIC ARCHED GROOVE

(75) Inventors: Xiaonian Zhang, Hubei (CN); Jiazhen Li, Hubei (CN)

(73) Assignee: Hubei Shengrong Environmental Protection Energy—Saving Science and Technology Ltd. (CN)

( * ) Notice: Subject to any disclaimer, the term of this patent is extended or adjusted under 35 U.S.C. 154(b) by 214 days.

(21) Appl. No.: 13/260,801

(22) PCT Filed: Mar. 30, 2010

(86) PCT No.: PCT/CN2010/000408

§ 371 (c)(1),
(2), (4) Date: Dec. 2, 2011

(87) PCT Pub. No.: WO2010/111894

PCT Pub. Date: Oct. 7, 2010

(65) Prior Publication Data

US 2012/0125821 A1 May 24, 2012

(30) Foreign Application Priority Data

Apr. 3, 2009 (CN) ..... 2009 1 0061407

(51) Int. Cl.
*B03C 1/00* (2006.01)

(52) U.S. Cl.
USPC ..... 209/224; 209/223.1; 209/225

(58) Field of Classification Search
USPC ..... 209/223.1, 224, 225, 226, 219, 221
See application file for complete search history.

(56) References Cited

U.S. PATENT DOCUMENTS 470,456 A * 3/1892 Thompson et al. ..... 209/225
3,021,951 A * 2/1962 Holt ..... 209/221
3,061,205 A * 10/1962 Lavallee ..... 241/24.14

(Continued)

FOREIGN PATENT DOCUMENTS

CN 1068758 A 2/1993
CN 2314853 Y 4/1999

(Continued)

OTHER PUBLICATIONS

International Search Report for Application No. PCT/CN2010/000408 mailed Jul. 8, 2010.

*Primary Examiner* — Stefanos Karmis
*Assistant Examiner* — Ernesto Suarez
(74) *Attorney, Agent, or Firm* — Knobbe, Martens, Olson & Bear, LLP

(57) ABSTRACT

The present invention discloses a method and a device for axial separation by the inner surface of a permanent magnetic arched groove, comprising: adsorbing materials to be selected that axially flow through the inner surface field strength and the gradient area of a rotating separation drum (2) by using the energy on the inner surface of a permanent magnetic arched groove (1); wherein materials with lower specific susceptibility pass through a selected material channel (13) and flow out of a low magnetic material outlet (9); materials with higher specific susceptibility are adsorbed on the rotating separation drum (2) and fall into a high magnetic material groove (7) under the action of its gravity; and materials with higher specific susceptibility flow through a high magnetic material outlet (8) and then are collected; thereby various materials with different specific susceptibilities can be separated.

4 Claims, 2 Drawing Sheets

(56) References Cited

U.S. PATENT DOCUMENTS

| | | | | | |
|---|---|---|---|---|---|
| 3,087,616 | A | * | 4/1963 | Pierson | 209/221 |
| 4,046,679 | A | * | 9/1977 | Schloemann | 209/212 |
| 4,194,968 | A | * | 3/1980 | Pfalzer et al. | 209/3 |
| 4,230,560 | A | * | 10/1980 | Nakajima | 209/212 |
| 4,533,053 | A | * | 8/1985 | Kenny et al. | 209/636 |
| 4,693,812 | A | * | 9/1987 | Bond et al. | 209/224 |
| 2012/0024762 | A1 | * | 2/2012 | Zhang et al. | 209/214 |

FOREIGN PATENT DOCUMENTS

| | | | |
|---|---|---|---|
| CN | 101518756 | A | 9/2009 |
| CN | 201375923 | Y | 1/2010 |
| JP | 8-52379 | A | 2/1996 |
| JP | 2002-95995 | A | 4/2002 |

* cited by examiner

METHOD AND DEVICE FOR AXIAL SEPARATION BY THE INNER SURFACE OF A PERMANENT MAGNETIC ARCHED GROOVE

FIELD OF THE INVENTION

The present invention relates to the technical field of environment protection devices, and in particular, to a method and a device for separation-drum axial separation by using the energy on the inner surface of a permanent magnetic arched groove.

BACKGROUND

For a conventional permanent magnetic separator or separating system, permanent magnetic materials are generally inserted in the outer surface of a drum or roller, and substances with different specific susceptibilities are separated by using the energy generated on the outer surface thereof.

There are two feeding modes for the conventional permanent magnetic separator or separating system, i.e., feeding on the outer surface of a permanent magnetic drum and feeding under the outer surface of a permanent magnetic drum. In the mode of feeding on the outer surface of a permanent magnetic drum, materials to be selected can directly contact the magnetic outer surface of the drum, the residence time on the magnetic outer surface of the drum is short, the adsorptive capacity is large, and the separation effect is poor, thus in such a mode, the yield may be increased, but the separation effect will be poor; in the mode of feeding under the outer surface of a permanent magnetic drum, there is a certain gap between the materials to be selected and the magnetic outer surface, the separation effect is good, but the yield is low, and greater object product will be run off.

In the traditional separation of materials to be selected, the stripping off of a high magnetic material is realized by a scraper or brush roller, or a magnetic material is partially inserted in the permanent magnetic drum or roller, and when the drum or roller rotates to an area without magnetic materials, the high magnetic material is flushed with water and falls into a high magnetic material groove or silo; for a conventional separator or separating system, the included angle between the whole system and the plane is nonadjustable, and its capacity for treating the materials to be selected is poor and the residence time of the materials to be selected on the permanent magnetic drum or roller is short; the surface field strength and gradient of the conventional permanent magnetic separator or separating system is a fixed value, thus the range of materials to be selected by a conventional permanent magnetic separator or separating system and the capacity of the conventional permanent magnetic separator or separating system is very limited.

SUMMARY

It is an object of the present invention to develop a device for physically separating metals, nonmetals or various substances with different specific susceptibilities by using the energy on the inner surface of a permanent magnetic arched groove, the principle of which lies in a method and a device for axial separation by the inner surface of a permanent magnetic arched groove, which can accomplish an effective separation by using the difference between the specific susceptibilities of substances.

The method for axial separation by the inner surface of a permanent magnetic arched groove according to the present invention comprises: adsorbing materials to be selected that axially flow through the inner surface field strength and the gradient area of a rotating separation drum 2 by using the energy on the inner surface of a fixed permanent magnetic arched groove 1. Under the action of gravity, materials with lower specific susceptibility axially pass through a selected material channel 13 including the separation drum 2 and the outer surface of an arched groove of a field strength gradient regulating mechanism 5, and flow out of a low magnetic material outlet 9; and under the action of the inner surface field strength and the gradient of the permanent magnetic arched groove 1, materials with higher specific susceptibility are adsorbed on the rotating separation drum 2; and because of the open ring in the upper part of the permanent magnetic arched groove 1, the materials with higher specific susceptibility adsorbed on the separation drum 2 directly fall into a high magnetic material groove 7 under the action of its gravity, pass through a high magnetic material outlet 8 and then are collected, so that various materials with different specific susceptibilities can be separated.

The device for axial separation by the inner surface of a permanent magnetic arched groove according to the present invention comprises: a bracket 0 and a separation drum assembly; wherein a permanent magnetic arched groove 1 of a permanent magnetic arched groove assembly is mounted outside the separation drum 2 of the separation drum assembly, and the permanent magnetic arched groove 1 is concentric with the separation drum 2; and because of the open ring in the upper part of the permanent magnetic arched groove 1, the materials with higher specific susceptibility adsorbed on the separation drum 2 fall into a high magnetic material groove 7 under the action of its gravity.

The permanent magnetic arched groove assembly comprises: a permanent magnetic arched groove 1 and a permanent magnetic arched groove support 10. The permanent magnetic arched groove 1 and the permanent magnetic arched groove support 10 are welded integrally or connected via a bolt, and the permanent magnetic arched groove support 10 is mounted and fixed on the bracket 0.

The separation drum assembly comprises: a separation drum 2, a separation drum support 11, a separation drum rotation regulating mechanism 3, a cleaning roller 12, a high magnetic material groove 7 and a field strength gradient regulating mechanism 5; wherein the two ends of the separation drum 2 are connected with roller wheels of the separation drum support 11 that are mounted on the bracket 0; the cleaning roller 12, the high magnetic material groove 7 and the field strength gradient regulating mechanism 5 are mounted inside the separation drum 2, the mutual support members on the two ends of the cleaning roller 12, the high magnetic material groove 7 and the field strength gradient regulating mechanism 5 are connected with the bracket 0, and the support member 51 of the field strength gradient regulating mechanism 5 is regulable; the selected material inlet silo 6 is connected with the bracket 0, the separation drum rotation regulating mechanism 3 is mounted on the bracket 0; a toothed wheel in the separation drum rotation regulating mechanism 3 is engaged with a toothed ring on the separation drum 2, or a friction wheel in the separation drum rotation regulating mechanism 3 is in friction combination with the outer surface of the separation drum.

The value of the field strength and the gradient area of the permanent magnetic arched groove 1 may be designed according to actual demands, and the angle between its field strength and gradient area is between 10° to 350°.

The cleaning roller 12 may rotate together with the separation drum 2, or it may be driven to rotate by an electric motor.

An inclination angle θ regulating mechanism 4 is mounted on the bracket 0, and the inclination angle θ regulating mechanism 4 makes the included angle θ between the plane and the whole device or the combination of the permanent magnetic arched groove 1 and the separation drum 2 regulable, with a range of approximately 0° to approximately 90°. The inclination angle θ regulating mechanism 4 may be a screw-thread elevating mechanism or a mechanism with other forms.

The field strength gradient regulating mechanism 5 comprises: an arched groove ABC and a support member 51 on the two ends of the arched groove; wherein the arched groove is consisted of a magnetic conductive material, and the thickness of the magnetic conductive material is greater than 0.5 mm and is smaller than the diameter of the separation drum 2.

The high magnetic material groove 7 is connected with the high magnetic material outlet 8, and the low magnetic material outlet 9 is fixed on the bracket 0.

A selected material channel 13 is formed by the inner surface of the separation drum 2 and the outer surface of an arched groove of the field strength gradient regulating mechanism 5.

The separation drum 2 is an integral concentric cylinder, which is concentric with the permanent magnetic arched groove 1.

By using the energy on the inner surface of the permanent magnetic arched groove 1, materials to be selected flow in and flow out from the inner surface of the separation drum 2. There is no gap between the materials to be selected and the surface of the separation drum 2, the contact time of the materials to be selected with the field strength and gradient of the inner surface of the separation drum 2 is increased, and the separation effect will be good. Because the materials to be selected flow in and flow out axially on the inner surface of the separation drum 2, as orthogonal to the radial magnetic field of the permanent magnetic arched groove 1, the materials to be selected contact with the field strength and the gradient area for N times, thus miss selection may be avoided, yield and recovery rate may be increased, and the separation effect may be improved.

By using the open ring part (an area without field strength and gradient) on the upper part of the permanent magnetic arched groove 1, high magnetic materials in the materials to be selected are automatically stripped off and fall into the high magnetic material groove 7, wherein the gravity of the material itself is used and no other auxiliary devices are needed to strip the materials to be selected off the field strength and the gradient area, which is easy and convenient.

The inclination angle θ regulating mechanism 4 makes the included angle between the plane and the whole device or the combination of the permanent magnetic arched groove 1 and the separation drum 2 variable and adjustable. The θ inclination angle may be adjusted according to the specific susceptibility of the materials to be selected, the treating capacity and the residence time of the materials to be selected on the inner surface of the separation drum 2 may be increased or decreased, thus the separation quality may be controlled.

The support member 51 on the two ends of the field strength gradient regulating mechanism 5 is connected with the bracket 0. The field strength and the gradient applied to the surface of the materials to be selected may be changed by adjusting the distance between the mechanism and the inner surface of the separation drum 2, thus the present device may adjust the field strength and gradient applicable for the separation of the materials to be selected according to the specific susceptibility of the materials to be selected. Therefore, the object of precisely separating the materials to be selected may be attained, the separation range and separation precision of the materials to be selected may be increased greatly, and the application range of the separation device may be enlarged.

The advantages of the method and the device for axial separation by the inner surface of a permanent magnetic arched groove according to the present invention lies in that: as compared with the current conventional permanent magnetic separation, the yield and recovery rate of the object product may be increased greatly (especially for the separation of some substances with lower specific susceptibility); the separation range of the materials to be selected may be enlarged, the content of valuable substances in the tailings and the offscum and the separation run off of the valuable substance may be reduced, thus energy conservation and discharge reduction may be attained in deed; and because the materials to be selected flow through the inner surface of the separation drum, the gap with the magnetic surface is small, and the magnetic energy will be fully utilized; the permanent magnetic arched groove assembly is fixed on the bracket 0, and no driving mechanism is needed; because of the open ring design on the upper part of the permanent magnetic arched groove 1, the materials with higher specific susceptibility adsorbed on the separation drum 2 fall into a high magnetic material groove 7 under the action of its gravity; the open ring design of the permanent magnetic arched groove 1 saves the permanent magnetic material; the value of the field strength and the gradient area of the permanent magnetic arched groove 1 may be designed according to actual demands, and the angle between its field strength and gradient area is between 10° to 350°; the open ring design of the permanent magnetic arched groove 1 may maximize the utilization of the field strength and the gradient area; no eccentric design is needed by the separation drum 2, and the manufacturing and mounting process will be simple; the separation range of the materials to be selected is large, and various substances such as metals, nonmetals and salts with high and low specific susceptibilities can be separated; the inner surface field strength and gradient in the magnetic region of the permanent magnetic arched groove 1 according to the present invention are radially distributed, and the materials to be selected flow axially, thus no miss selection occurs, the yield is high, and the separation effect is good; the overall inclination angle θ of the present device is regulable, and the throughput and the residence time of the materials to be selected may be changed by adjusting the angle θ; the field strength and the gradient may be changed to meet the requirements of the materials to be selected by adjusting the field strength gradient regulating mechanism 5 according to the requirements on the specific susceptibility of the materials to be selected; the structure of such a permanent magnetic arched groove may be applied to a range of materials to be selected on which permanent magnetic round drum cannot be used.

DETAILED DESCRIPTION OF THE EMBODIMENTS

Embodiment 1

Figure 1:
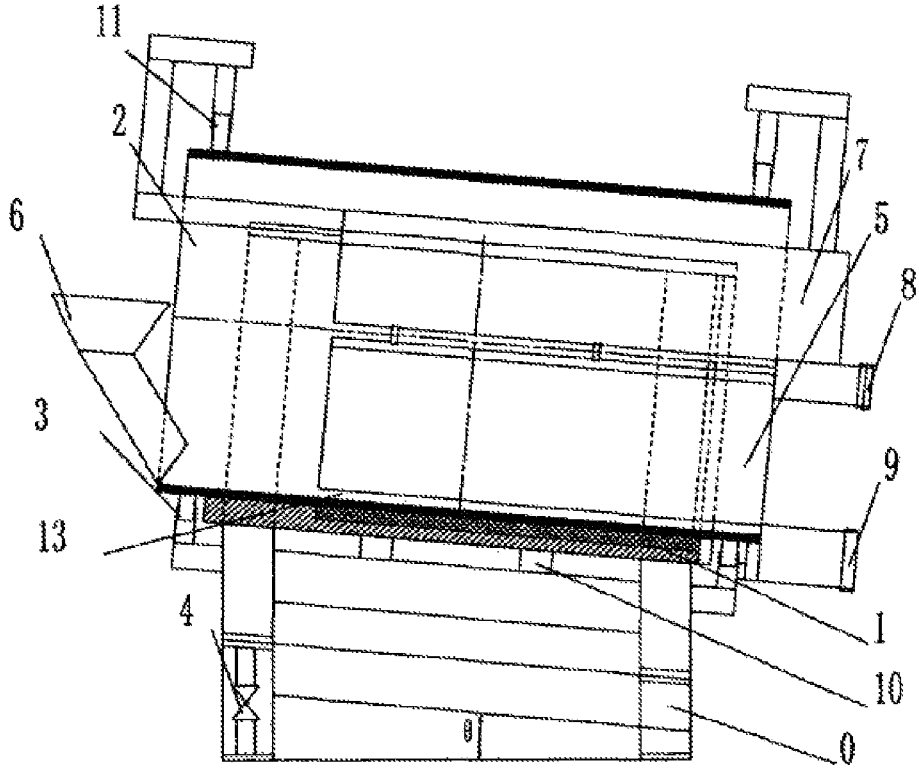
FIG. 1 is a structural representation of a device for axial separation by the inner surface of a permanent magnetic arched groove.

A method for axial separation by the inner surface of a permanent magnetic arched groove, comprising: choosing the offscum discharged after electrolyzing manganese carbonate to obtain manganese metal, as the materials to be selected. The average content of manganese in the manganese carbonate offscum is approximately 6.47%, and the average granularity is approximately −40 mesh, which occupies about 90%. The specific susceptibility of manganese carbonate is about 100 to about $600\times10^{-6}$ $cm^3/g$, and the field strength and the gradient is preferably adjusted to a value that can adsorb materials with such a specific susceptibility. The offscum is mixed with water to form a flowable paste, the flowable paste is fed from the selected material inlet 6, flows through the inner surface of the rotating eccentric drum 2 and enters the selected material channel 13; under the action of the field strength and the gradient generated by the permanent magnetic arched groove 1 and the field strength gradient regulating mechanism 5, the manganese carbonate in the materials to be selected are adsorbed on the rotating separation drum 2; when the separation drum 2 rotates (both clockwise and anticlockwise rotation can be employed) to the upper end open ring of the permanent magnetic arched groove 1, and under the action of gravity, the manganese carbonate in the materials to be selected automatically falls into the high magnetic material groove 7, and then it flows out via the high magnetic material outlet 8; the cleaning roller 12 performs rotational cleaning on the inner surface of the separation drum 2, which guarantees a clean and convenient adsorption of the materials to be selected in the next cycle. The residual materials with lower specific susceptibility flow to the low magnetic material outlet 9 via the selected material channel 13, where they are discharged. The content of the manganese carbonate-grade manganese collected by the method and the separation device according to this embodiment is as high as approximately 27%, which is approximately 10 percentage points higher than the 17% content of mine-grade manganese, and the average content of manganese in the secondary offscum is less than approximately 1%.

Embodiment 2

Figure 2:
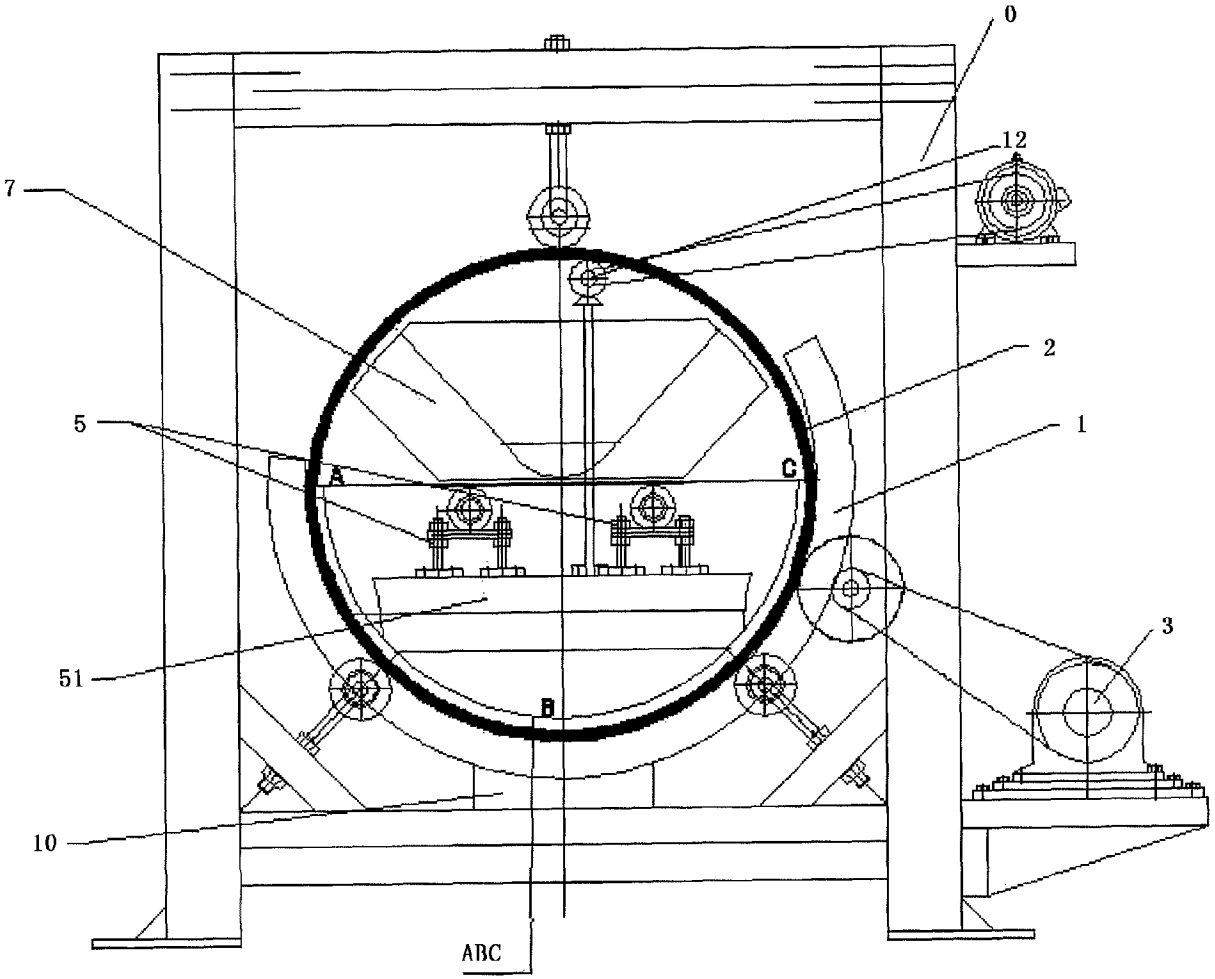
FIG. 2 is a lateral view of a device for axial separation by the inner surface of a permanent magnetic arched groove.

As shown in FIG. 1 and FIG. 2, a device for axial separation by the inner surface of a permanent magnetic arched groove comprises: a bracket 0 and a separation drum assembly; wherein a permanent magnetic arched groove 1 of a permanent magnetic arched groove assembly is mounted outside a separation drum 2 of the separation drum assembly, and the permanent magnetic arched groove 1 is concentric with the separation drum 2; because of the open ring in the upper part of the permanent magnetic arched groove 1, the materials with higher specific susceptibility adsorbed on the separation drum 2 fall into a high magnetic material groove 7 under the action of its gravity.

The permanent magnetic arched groove assembly comprises: a permanent magnetic arched groove 1 and a permanent magnetic arched groove support 10. The permanent magnetic arched groove 1 and the permanent magnetic arched groove support 10 are welded integrally or connected via a bolt, and the permanent magnetic arched groove support 10 is mounted and fixed on the bracket 0.

The separation drum assembly comprises: a separation drum 2, a separation drum support 11, a separation drum rotation regulating mechanism 3, a cleaning roller 12, a high magnetic material groove 7 and a field strength gradient regulating mechanism 5; wherein the separation drum 2 are connected with roller wheels of the separation drum support 11 of which the two ends are mounted on the bracket 0; the cleaning roller 12, the high magnetic material groove 7 and the field strength gradient regulating mechanism 5 are mounted inside the separation drum 2; the mutual support members on the two ends of the cleaning roller 12, the high magnetic material groove 7 and the field strength gradient regulating mechanism 5 are connected with the bracket 0, and the support member 51 of the field strength gradient regulating mechanism 5 is regulable; the selected material inlet silo 6 is connected with the bracket 0, the separation drum rotation regulating mechanism 3 is mounted on the bracket 0; a toothed wheel in the separation drum rotation regulating mechanism 3 is engaged with a toothed ring on the separation drum 2, or a friction wheel in the separation drum rotation regulating mechanism 3 is in friction combination with the outer surface of the separation drum 2.

An inclination angle θ regulating mechanism 4 is mounted on the bracket 0, and the inclination angle θ regulating mechanism 4 makes the included angle θ between the plane and the whole device or the combination of the permanent magnetic arched groove 1 and the separation drum 2 regulable, with a range of 0° to 90°. The inclination angle θ regulating mechanism 4 may be a screw-thread elevating mechanism or a mechanism with other forms.

The field strength gradient regulating mechanism 5 comprises: an arched groove ABC and a support member 51 on the two ends of the arched groove; wherein the arched groove is consisted of a magnetic conductive material, and the thickness of the magnetic conductive material is greater than 0.5 mm and is smaller than the diameter of the separation drum 2.

The high magnetic material groove 7 is connected with the high magnetic material outlet 8, and the low magnetic material outlet 9 is fixed on the bracket 0.

The value of the field strength and the gradient area of the permanent magnetic arched groove 1 may be designed according to actual demands, and the angle between the field strength and the gradient area is between approximately 10° to approximately 350°.

What is claimed is:

1. A device for axial separation by the inner surface of a permanent magnetic arched groove, comprising:

a bracket and a separation drum assembly;

wherein the permanent magnetic arched groove of a permanent magnetic arched groove assembly is mounted outside a separation drum of the separation drum assembly, and the permanent magnetic arched groove is concentric with the separation drum;

wherein the separation drum assembly comprises:

the separation drum, a separation drum support, a separation drum rotation regulating mechanism, a cleaning roller, a high magnetic material groove, and a field strength gradient regulating mechanism;

wherein the two ends of the separation drum are connected with roller wheels of the separation drum support that is mounted on the bracket;

wherein the cleaning roller, the high magnetic material groove and the field strength gradient regulating mechanism are mounted inside the separation drum;

wherein a mutual support member of the cleaning roller, the high magnetic material groove and the field strength gradient regulating mechanism mounted inside the separation drum are connected with the bracket, a support member of the field strength gradient regulating mechanism is regulable, a selected material inlet silo is connected with the bracket, the separation drum rotation regulating mechanism is mounted on the bracket; and a toothed wheel in the separation drum rotation regulating mechanism is engaged with a toothed ring on the separation drum, or a friction wheel in the separation drum rotation regulating mechanism is in friction combination with the outer surface of the separation drum;

wherein the field strength and the gradient applied to the surface of the materials to be selected can be changed by adjusting the distance between the field strength gradient regulating mechanism and the inner surface of the separation drum.

2. The device for axial separation by the inner surface of the permanent magnetic arched groove according to claim 1, wherein the permanent magnetic arched groove assembly comprises:

the permanent magnetic arched groove and a permanent magnetic arched groove support;

wherein the permanent magnetic arched groove and the permanent magnetic arched groove support are welded integrally or connected via a bolt, and the permanent magnetic arched groove support is mounted and fixed on the bracket.

3. The device for axial separation by the inner surface of the permanent magnetic arched groove according to claim 1, wherein an inclination angle θ regulating mechanism is mounted on the bracket, and the inclination angle θ regulating mechanism makes an included angle θ between a plane and the device or a combination of the permanent magnetic arched groove and the separation drum regulable with a range of about 0° to about 90°.

4. The device for axial separation by the inner surface of the permanent magnetic arched groove according to claim 1, wherein the field strength gradient regulating mechanism comprises an arched groove, wherein the arched groove is formed of a magnetic conductive material, and the thickness of the magnetic conductive material is greater than about 0.5 mm and is smaller than about the diameter of the separation drum.

* * * * *